US012790091B2

(12) United States Patent
Wu et al.

(10) Patent No.: US 12,790,091 B2
(45) Date of Patent: Nov. 10, 2026

(54) PACKAGING MATERIAL STRUCTURE AND PACKAGING STRUCTURE

(71) Applicant: Wistron NeWeb Corporation, Hsinchu (TW)

(72) Inventors: Pin-Ying Wu, Hsinchu (TW); Hsiao-Hsuan Huang, Hsinchu (TW); Yi-Ying Wu, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 18/812,107

(22) Filed: Aug. 22, 2024

(65) Prior Publication Data

US 2025/0187806 A1 Jun. 12, 2025

(30) Foreign Application Priority Data

Dec. 11, 2023 (TW) ..... 112148065

(51) Int. Cl.
*B65D 81/127* (2006.01)
*B65D 5/50* (2006.01)
*B65D 73/00* (2006.01)

(52) U.S. Cl.
CPC ..... *B65D 73/0085* (2013.01)

(58) Field of Classification Search
CPC ..... B65D 81/053; B65D 81/054; B65D 2581/053
USPC ..... 206/453, 476, 586; 229/199
See application file for complete search history.

(56) References Cited

U.S. PATENT DOCUMENTS 1,713,548 A * 5/1929 Oppenheim ..... B65D 5/5035 220/919
2,707,587 A * 5/1955 Wittstein ..... B65D 5/22 229/178
3,613,985 A * 10/1971 Goodsite ..... B65D 81/054 229/199
3,822,036 A * 7/1974 Goodsite ..... B65D 81/056 206/586
7,900,910 B2 * 3/2011 Horiuchi ..... B41J 13/0081 271/145

(Continued)

FOREIGN PATENT DOCUMENTS

JP 2005231641 A 9/2005
JP 2018140780 A 9/2018

(Continued)

*Primary Examiner* — Luan K Bui
(74) *Attorney, Agent, or Firm* — McClure, Qualey & Rodack, LLP

(57) ABSTRACT

A packaging material structure includes a supporting plate, a base plate, a first foldable area, an inserting element and an inserting slot. The supporting plate has a supporting side and a supporting surface. The base plate is connected to the supporting side and has a base plate side, and the base plate includes two base plate folding lines separately disposed on the base plate. The first foldable area is disposed on the supporting plate, and the supporting plate and the base plate are bent toward each other along the first foldable area. The inserting element is integrally connected to the base plate side. The inserting slot is disposed on the supporting plate. The base plate is for bending toward the supporting surface along the two base plate folding lines, so that the inserting element is correspondingly inserted in the inserting slot.

24 Claims, 11 Drawing Sheets

(56) References Cited

U.S. PATENT DOCUMENTS

| | | | | |
|---|---|---|---|---|
| 2003/0155272 | A1* | 8/2003 | Ragsdale | B65D 5/5069 206/586 |
| 2008/0099359 | A1* | 5/2008 | Suito | B41J 13/0081 206/453 |

FOREIGN PATENT DOCUMENTS

| | | | |
|---|---|---|---|
| TW | 459752 | U | 10/2001 |
| TW | 202142462 | A | 11/2021 |
| WO | 2023181858 | A1 | 9/2023 |

* cited by examiner

PACKAGING MATERIAL STRUCTURE AND PACKAGING STRUCTURE

RELATED APPLICATIONS

This application claims priority to Taiwan Application Serial Number 112148065, filed Dec. 11, 2023, which is herein incorporated by reference.

BACKGROUND

Technical Field

The present disclosure relates to a packaging material structure and a packaging structure. More particularly, the present disclosure relates to a packaging material structure and a packaging structure capable of firmly positioning an object to be positioned and allowing convenience for picking and placing thereof.

Description of Related Art

The packaging material is a structure used to position goods and protect the integrities of the goods during transportation or movement. Most conventional packaging materials are made of plastic materials. The packaging materials made of the plastic materials have placed a great burden on the global environment because the plastic materials are indecomposable. Hence, it has become an evolving trend in the packaging industry for goods without packaging or using plastic-free packaging materials made of non-plastic materials.

The conventional packaging structures are almost packaging boxes that are folded outward or folded inward or cartons with only peripheral walls. The packaging structure has an allowance because of the manufacturing tolerances or to corresponding to the shape of the goods. Hence, the goods are easily damaged due to shaking during transportation or movement caused by a space between the goods and the packaging structure when the goods do not have plastic packaging (such as plastic bags or bubble wraps). On the other hand, the convenience of picking and placing the goods is not ideal when there is no space between the goods and the packaging structure.

Therefore, how to develop a packaging material structure that can be convenient for picking and placing the goods and effectively position the goods to the packaging structure has become a subject with economic value.

SUMMARY

According to one aspect of the present disclosure, a packaging material structure includes a supporting plate, a base plate, a first foldable area, an inserting element and an inserting slot. The supporting plate has a supporting side and a supporting surface. The base plate is connected to the supporting side and has a base plate side, and the base plate includes two base plate folding lines separately disposed on the base plate. The first foldable area is disposed on the supporting plate, and the supporting plate and the base plate are bent toward each other along the first foldable area. The inserting element is integrally connected to the base plate side. The inserting slot is disposed on the supporting plate. The base plate is for bending toward the supporting surface along the two base plate folding lines, so that the inserting element is correspondingly inserted in the inserting slot.

According to another aspect of the present disclosure, a packaging material structure includes a supporting plate, a base plate, a first foldable area, a side plate, a second foldable area, a positioning element and a positioning slot. The supporting plate has a supporting side and a supporting surface. The base plate is connected to the supporting side and has a base plate side, and the base plate includes two base plate folding lines separately disposed on the base plate. The first foldable area is disposed on the supporting plate, and the supporting plate and the base plate are bent toward each other along the first foldable area. The side plate is connected to the base plate side, and the side plate includes a first plate element, a second plate element and a side plate folding line. The first plate element is connected to the base plate. The second plate element is connected to the first plate element. The side plate folding line is disposed between the first plate element and the second plate element, and the first plate element and the second plate element are bent toward each other along the side plate folding line. The second foldable area is disposed on the side plate, and the side plate is bent toward the supporting surface along the second foldable area. The positioning element is integrally connected to the second plate element. The positioning slot is recessed on the supporting side. When the base plate is bent toward the supporting surface along the two base plate folding lines, and the side plate is bent toward the supporting surface along the second foldable area, the base plate and the side plate form a frame body. When the base plate and the side plate form the frame body, the first plate element and the second plate element are bent along the side plate folding line, and then the second plate element is located in the frame body and stacked on the base plate, so that the positioning element is correspondingly inserted in the positioning slot.

According to further another aspect of the present disclosure, a packaging structure includes a box body and a packaging material structure. The box body has an accommodating space. The packaging material structure is detachably disposed in the accommodating space, wherein the packaging material structure abuts against an inner surface of the box body, and the packaging material structure includes a supporting plate, a base plate, a first foldable area, a side plate, a second foldable area, a positioning element and a positioning slot. The supporting plate has a supporting side and a supporting surface. The base plate is connected to the supporting side and has a base plate side, and the base plate includes two base plate folding lines separately disposed on the base plate. The first foldable area is disposed on the supporting plate, and the supporting plate and the base plate are bent toward each other along the first foldable area. The side plate is connected to the base plate side, and the side plate includes a first plate element, a second plate element and a side plate folding line. The first plate element is connected to the base plate. The second plate element is connected to the first plate element. The side plate folding line is disposed between the first plate element and the second plate element, and the first plate element and the second plate element are bent toward each other along the side plate folding line. The second foldable area is disposed on the side plate, and the side plate is bent toward the supporting surface along the second foldable area. The positioning element is integrally connected to the second plate element. The positioning slot is recessed on the supporting side. When the base plate is bent toward the supporting surface along the two base plate folding lines, and the side plate is bent toward the supporting surface along the second foldable area, the base plate and the side plate form a frame body. When the base plate and the side plate form the frame body, the first plate element and the second plate element are bent along the side plate folding line, and then the second plate element is located in the frame body and stacked on the base plate, so that the positioning element is correspondingly inserted in the positioning slot.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
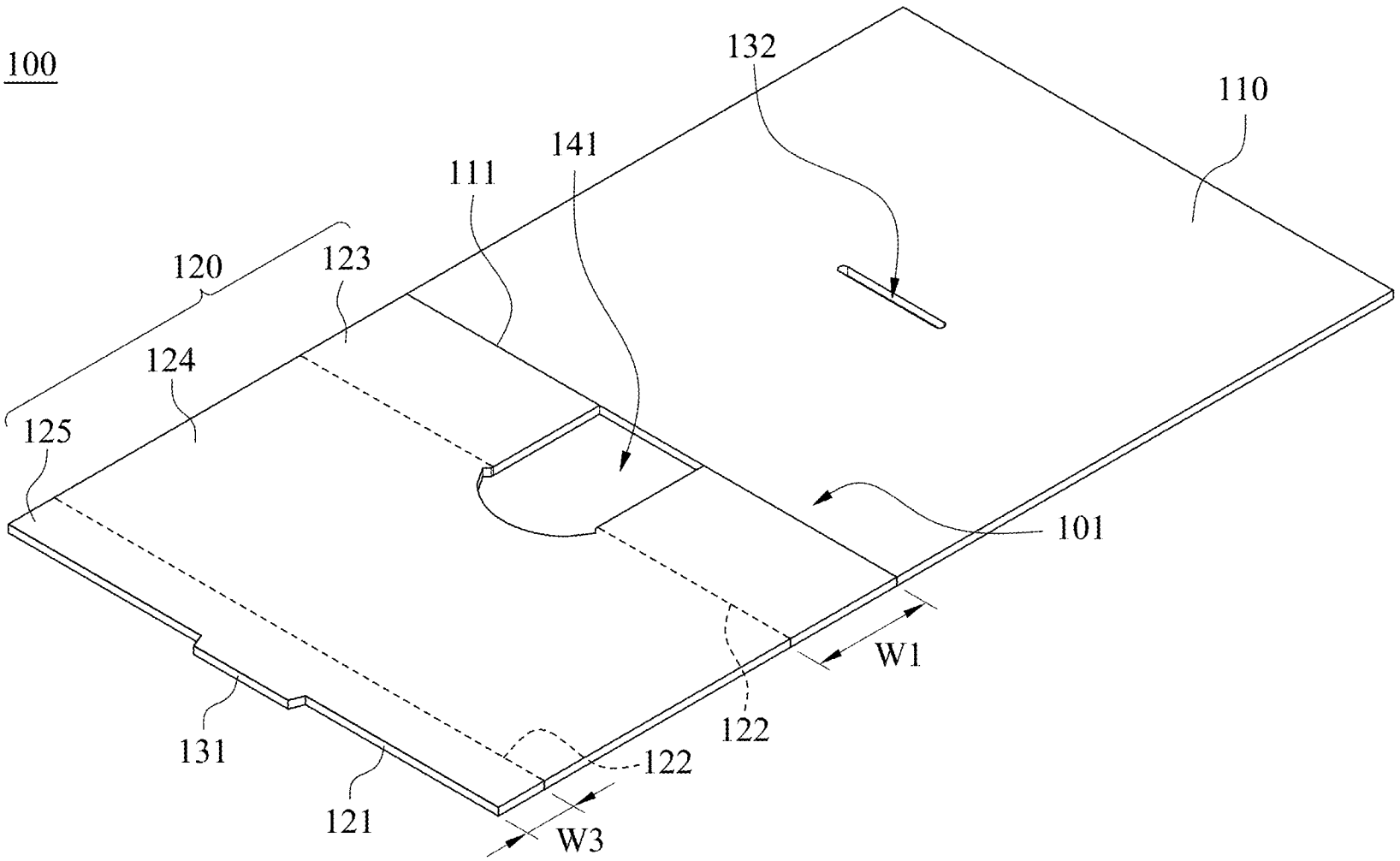
FIG. 1 is a schematic view of a packaging material structure according to the first embodiment of the present disclosure.

The present disclosure will be further exemplified by the following specific embodiments. However, the embodiments can be applied to various inventive concepts and can be embodied in various specific ranges. The specific embodiments are only for the purposes of description and are not limited to these practical details thereof. Furthermore, in order to simplify the drawings, some conventional structures and elements will be illustrated in the drawings by a simple and schematic way. The duplicated elements may be denoted by the same number or similar numbers.

Reference is made to FIG. 1. FIG. 1 is a schematic view of a packaging material structure 100 according to the first embodiment of the present disclosure. The packaging material structure 100 includes a supporting plate 110, a base plate 120, a first foldable area 101, an inserting element 131 and an inserting slot 132.

Figure 2:
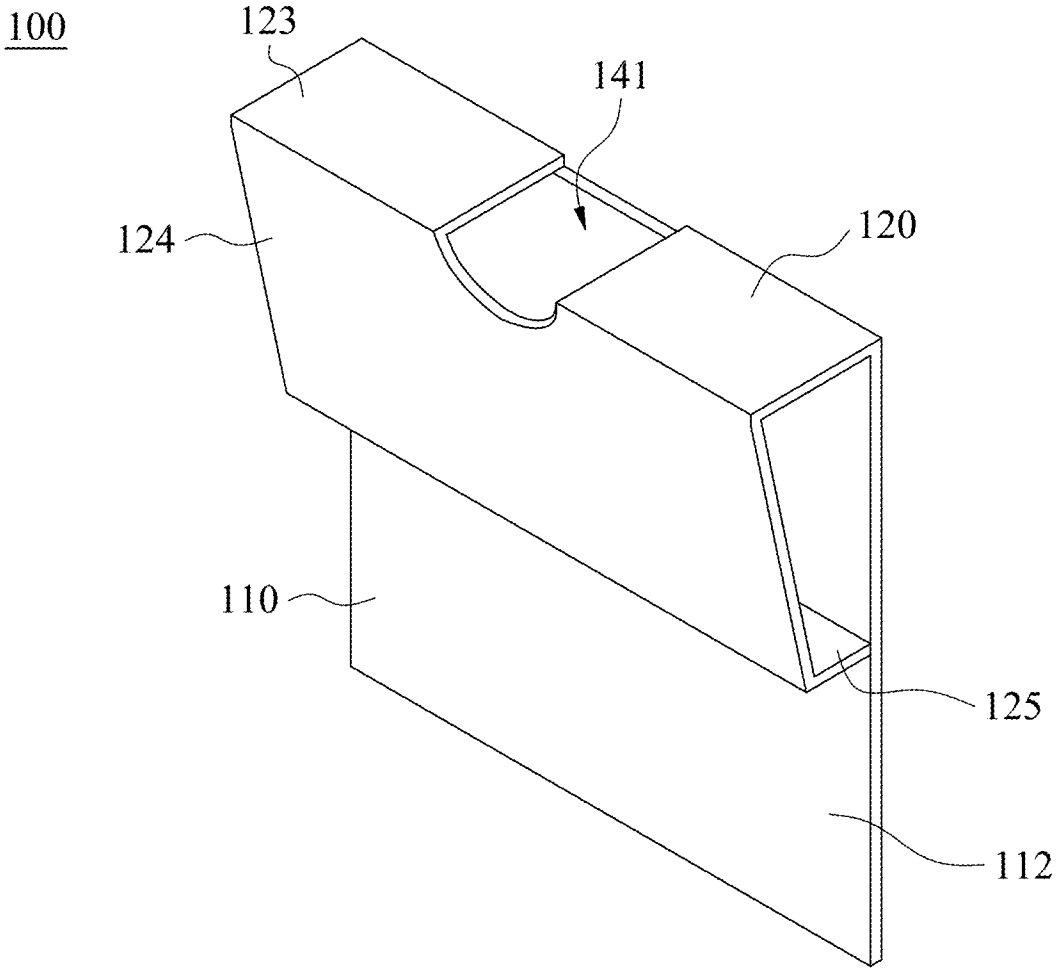
FIG. 2 is a bending schematic view of the packaging material structure of FIG. 1.

The supporting plate 110 has a supporting side 111 and a supporting surface 112 (as labeled in FIG. 2).

The base plate 120 is connected to the supporting side 111 and has a base plate side 121, wherein the base plate 120 includes two base plate folding lines 122, and the two base plate folding lines 122 are separately disposed on the base plate 120. Specifically, in the packaging material structure 100 of FIG. 1, the base plate side 121 is located on one side of the base plate 120 away from the supporting plate 110, and the base plate 120 can be divided into a first portion 123, a second portion 124 and a third portion 125 by the two base plate folding lines 122. The first portion 123 is connected to the supporting plate 110, and the second portion 124 is disposed between the first portion 123 and the third portion 125.

Further, the base plate folding lines 122 can be any lines defining hinge lines in the base plate 120. The base plate folding lines 122 are used to facilitate the folding of the first portion 123, the second portion 124 and the third portion 125 relative to each other or indicate the optimal folding positions on the base plate 120 in other methods. Furthermore, each of the base plate folding lines 122 can be formed by a single indentation, a single half-cut line, a perforated line, a cutting line, a short-slit line, a half-cut line, an indentation line, etc., and any combination thereof, and the present disclosure is not limited thereto.

As shown in FIG. 1, in the packaging material structure 100 of the present disclosure, when a maximum width of the first portion 123 is W1, and a maximum width of the third portion 125 is W3, the following condition can be satisfied: $W1 \geq W3$. Therefore, a space between an object to be positioned (not shown) and a box body (not shown) can be effectively filled with the packaging material structure 100 that can accord to the shape of the object to be positioned, so that the object to be positioned from being damaged due to shaking during transportation can be avoided, and the picking and placing of the object to be positioned can be more convenient. Further, the operation and deformation method of the packaging material structure 100 of the present disclosure will be described in the following paragraphs with the packaging material structure 200 in FIG. 7.

The first foldable area 101 is disposed on the supporting plate 110, and the supporting plate 110 and the base plate 120 are bent toward each other along the first foldable area 101. In detail, in the packaging material structure 100, the supporting plate 110 can be integrally connected to the base plate 120, and the first foldable area 101 can be disposed on the supporting side 111 of the supporting plate 110 by a creasing method. Therefore, the supporting plate 110 and the base plate 120 can be bent toward each other by the first foldable area 101, wherein the adequate support and connection can be provided by the first foldable area 101, so that the supporting plate 110 and the base plate 120 are not easily to be broken or separated due to bending. It should be mentioned that the first foldable area 101 can also be disposed on the supporting side 111 of the supporting plate 110 by a perforating method, a cutting method, etc., and a combination thereof, and the present disclosure is not limited to the above method.

The inserting element 131 is integrally connected to the base plate side 121, and the inserting slot 132 is disposed on the supporting plate 110. Specifically, the inserting element 131 can be integrally connected to the third portion 125 of the base plate 120. Therefore, when the base plate 120 is bent toward the supporting surface 112 along the two base plate folding lines 122, the inserting element 131 can be correspondingly inserted in the inserting slot 132, so that the assembling convenience of the packaging material structure 100 of the present disclosure can be enhanced. Further, the inserting element 131 and the inserting slot 132 can be configured into different shapes as required. However, the shape of the inserting element 131 and the shape of the inserting slot 132 should match each other so as to position the base plate 120 that is bent in a snap-fit method. Therefore, an excellent structural stability of the packaging material structure 100 of the present disclosure can be achieved. It should be mentioned that the inserting element 131 and the inserting slot 132 of the present disclosure are not limited to the shapes disclosed in the drawings.

Furthermore, the packaging material structure 100 can further include a slot hole 141. The slot hole 141 is disposed on the first portion 123. Specifically, in the packaging material structure 100 of the present disclosure, the slot hole 141 can extend from the supporting side 111 toward the base plate side 121 and be disposed on the first portion 123. Hence, when the base plate 120 is bent toward the supporting surface 112 along the two base plate folding lines 122, and the inserting element 131 is correspondingly inserted in the inserting slot 132, a space for the user's fingers to operate can be provided by the slot hole 141. Therefore, it is favorable for the user to pull the first portion 123 to move relative to the supporting side 111 by the slot hole 141, and the picking and placing of the object to be positioned can be more convenient. It should be mentioned that the slot hole 141 can also be disposed on the first portion 123 parallel to an extending direction of the supporting side 111, but the present disclosure is not limited thereto.

Further, the packaging material structure 100 can be made of a paper material, the paper material can be a cardboard or a corrugated paper, wherein the corrugated paper can be a G flute corrugated paper, a F flute corrugated paper, an E flute corrugated paper, a B flute corrugated paper, a C flute corrugated paper, an A flute corrugated paper, a BC flute corrugated paper, a BE flute corrugated paper, an AB corrugated paper, etc., and the packaging material structure 100 can also be integrally formed by bending other plate, but the present disclosure is not limited thereto.

Reference is made to FIG. 1 and FIG. 2, wherein FIG. 2 is a bending schematic view of the packaging material structure 100 of FIG. 1. The assembly method and details of the packaging material structure 100 of the present disclosure are described in the following paragraphs with FIG. 1 and FIG. 2.

As shown in FIG. 1 and FIG. 2, the supporting plate 110 and the base plate 120 are bent toward each other along the first foldable area 101 when the packaging material structure 100 is to be assembled, and then the first portion 123, the second portion 124 and the third portion 125 are bent toward the supporting surface 112 along the two base plate folding lines 122. At the same time, the third portion 125 and the supporting plate 110 are close to each other, so that the inserting element 131 can be correspondingly inserted in the inserting slot 132. Therefore, the supporting plate 110, the first portion 123, the second portion 124 and the third portion 125 of the base plate 120 that are bent can be positioned.

By the arrangements that the supporting plate 110 and the base plate 120 are bent toward each other along the first foldable area 101, and the base plate 120 is for bending toward the supporting surface 112 along the two base plate folding lines 122, the packaging material structure 100 of the present disclosure can be presented as a frame body that is roll-shaped in appearance. Therefore, the assembling convenience of the packaging material structure 100 can be greatly achieved, the packaging material structure 100 can be effectively inserted in and fill with the space between the object to be positioned and the box body, and the object to be positioned from being damaged due to shaking during transportation can be avoided. Further, the picking and placing of the object to be positioned can be more convenient by the arrangement of the packaging material structure 100 including the slot hole 141.

Figure 3:
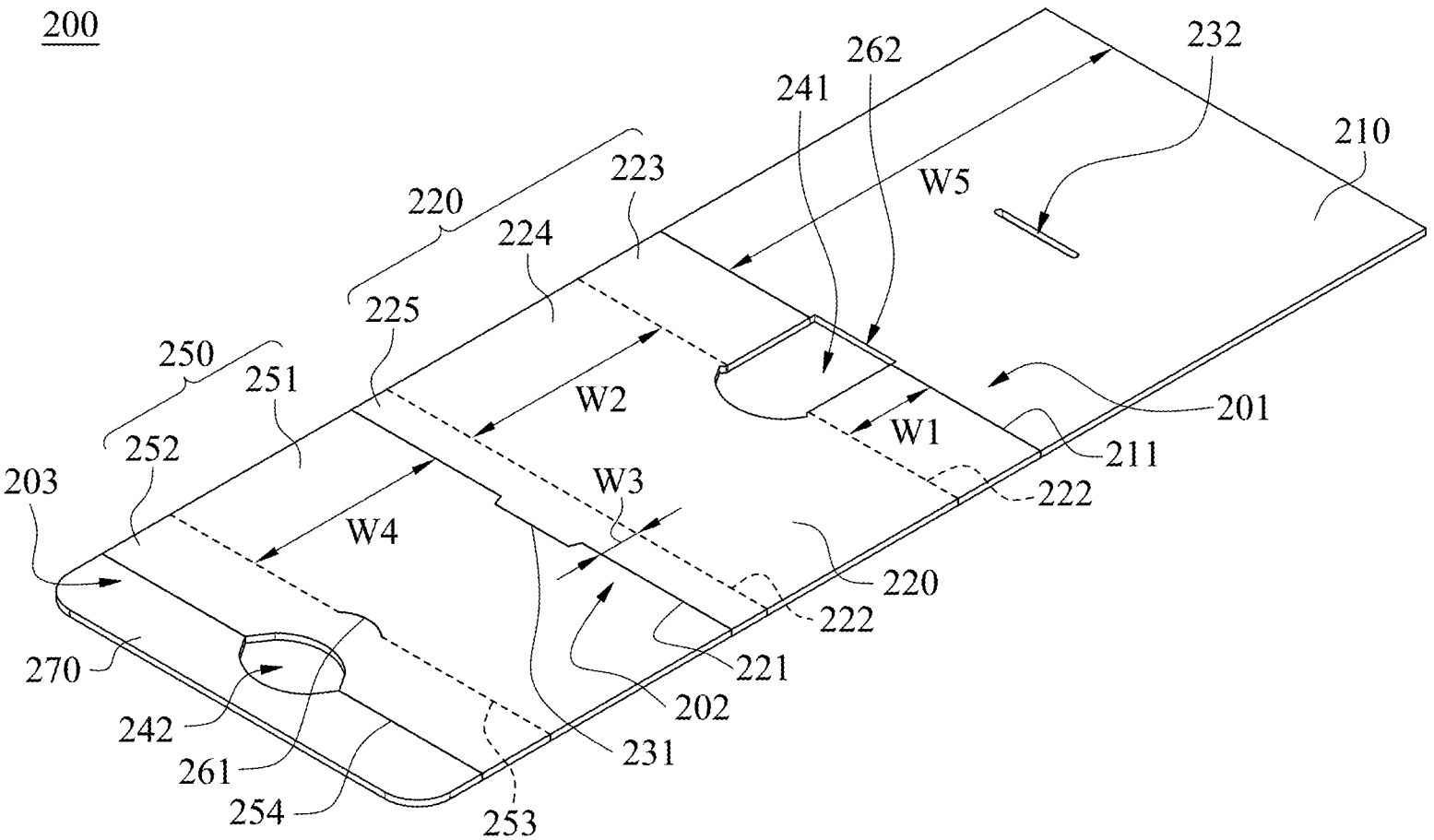
FIG. 3 is a schematic view of a packaging material structure according to the second embodiment of the present disclosure.

Reference is made to FIG. 3, which is a schematic view of a packaging material structure 200 according to the second embodiment of the present disclosure. The packaging material structure 200 includes a supporting plate 210, a base plate 220, a first foldable area 201, an inserting element 231, an inserting slot 232, a side plate 250, a second foldable area 202, a slot hole 241, an opening 242, a positioning element 261, a positioning slot 262, an end plate 270 and a third foldable area 203.

Figure 4:
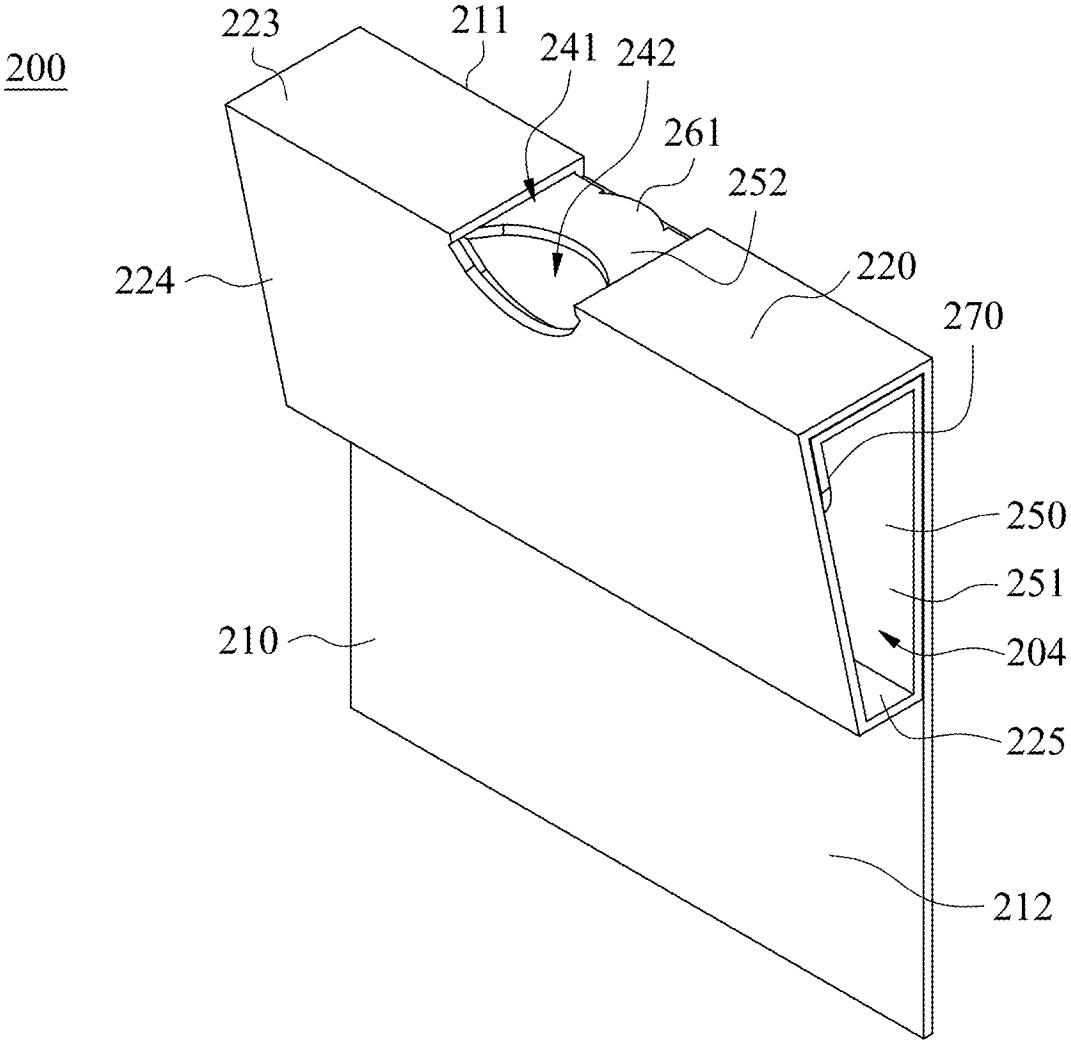
FIG. 4 is a bending schematic view of the packaging material structure of FIG. 3.
Figure 7:
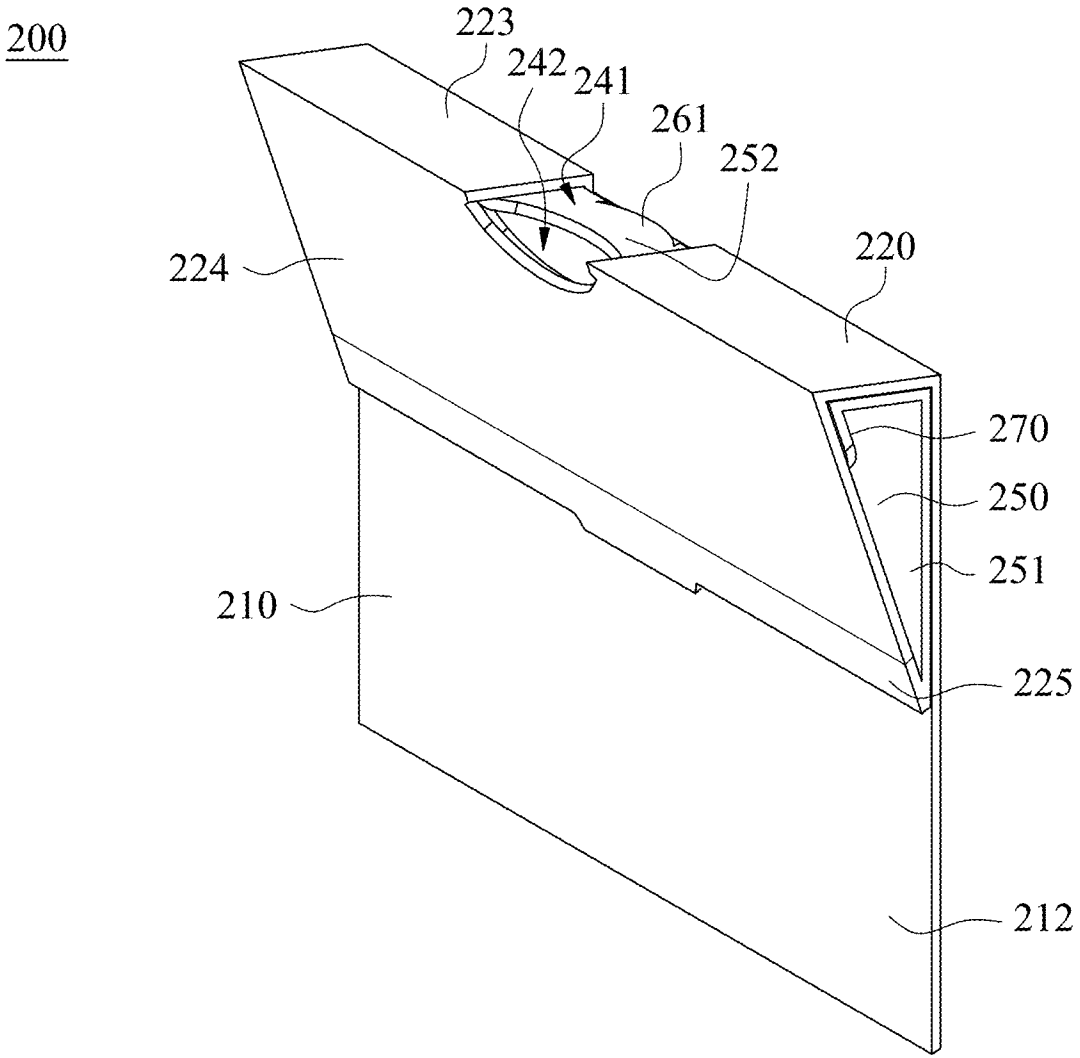
FIG. 7 is an adjusting schematic view of the packaging material structure of FIG. 4.

The supporting plate 210 has a supporting side 211 and a supporting surface 212 (as labeled in FIG. 4 and FIG. 7).

The base plate 220 is connected to the supporting side 211 and has a base plate side 221, wherein the base plate 220 includes two base plate folding lines 222, and the two base plate folding lines 222 are separately disposed on the base plate 220. Specifically, in the packaging material structure 200 of FIG. 3, the base plate side 221 is located on one side of the base plate 220 away from the supporting plate 210, and the base plate 220 can be divided into a first portion 223, a second portion 224 and a third portion 225 by the two base plate folding lines 222. Further, the first portion 223 is connected to the supporting plate 210, and the second portion 224 is disposed between the first portion 223 and the third portion 225.

Furthermore, the base plate folding lines 222 can be any lines defining hinge lines in the base plate 220. The base plate folding lines 222 are used to facilitate the folding of the first portion 223, the second portion 224 and the third portion 225 relative to each other or indicate the optimal folding positions on the base plate 220 in other methods. Furthermore, each of the base plate folding lines 222 can be formed by a single indentation, a single half-cut line, a perforated line, a cutting line, a short-slit line, a half-cut line, an indentation line, etc., and any combination thereof, and the present disclosure is not limited thereto.

The first foldable area 201 is disposed on the supporting plate 210, and the supporting plate 210 and the base plate 220 are bent toward each other along the first foldable area 201. In detail, in the packaging material structure 200, the supporting plate 210 can be integrally connected to the base plate 220, and the first foldable area 201 can be disposed on the supporting side 211 of the supporting plate 210 by the creasing method. Therefore, the supporting plate 210 and the base plate 220 can be bent toward each other by the first foldable area 201, wherein the adequate support and connection can be provided by the first foldable area 201, so that the supporting plate 210 and the base plate 220 are not easily to be broken or separated due to bending. It should be mentioned that the first foldable area 201 can also be disposed on the supporting side 211 of the supporting plate 210 by the perforating method, the cutting method, etc., and the combination thereof, and the present disclosure is not limited to the above method.

The inserting element 231 is integrally connected to the base plate side 221, and the inserting slot 232 is disposed on the supporting plate 210. In specific, the inserting element 231 can be integrally connected to the third portion 225 of the base plate 220. Hence, when the base plate 220 is bent toward the supporting surface 212 along the two base plate folding lines 222, the inserting element 231 can be correspondingly inserted in the inserting slot 232, so that the assembling convenience of the packaging material structure 200 of the present disclosure can be enhanced. Further, the inserting element 231 and the inserting slot 232 can be configured into different shapes as required. However, the shape of the inserting element 231 and the shape of the inserting slot 232 should match each other so as to position the base plate 220 that is bent in the snap-fit method. Therefore, an excellent structural stability of the packaging material structure 200 of the present disclosure can be achieved. It should be mentioned that the inserting element 231 and the inserting slot 232 of the present disclosure are not limited to the shapes disclosed in the drawings. Further, in some embodiments, the packaging material structure 200 does not include the inserting element 231 and the inserting slot 232, and the integral structure of the packaging material structure 200 is stabilized by the positioning element 261 and the positioning slot 262, which does not depart from the scope or spirit of the present disclosure.

The side plate 250 is integrally connected to the base plate side 221, and the side plate 250 has a side-plate side 254. Specifically, in the second embodiment of FIG. 3, the side-plate side 254 is parallel to the base plate side 221, and the side plate 250 includes a first plate element 251, a second plate element 252 and a side plate folding line 253. The first plate element 251 is connected to the base plate 220, the second plate element 252 is connected to the first plate element 251, the side plate folding line 253 is disposed between the first plate element 251 and the second plate element 252, and the first plate element 251 and the second plate element 252 can be bent toward each other along the side plate folding line 253.

The second foldable area 202 is disposed on the side plate 250, and the side plate 250 can be bent toward the supporting surface 212 along the second foldable area 202. In detail, in the packaging material structure 200, the second foldable area 202 can be disposed on one side (its reference numeral is omitted) of the side plate 250 connected to the base plate 220 by the creasing method so as to facilitate the user to bend the side plate 250, but the present disclosure is not limited to the creasing method.

The slot hole 241 is disposed on the first portion 223. Specifically, in the packaging material structure 200, the slot hole 241 can extend from the supporting side 211 toward the base plate side 221 and be disposed on the first portion 223. Hence, when the base plate 220 is bent toward the supporting surface 212 along the two base plate folding lines 222, and the inserting element 231 is correspondingly inserted in the inserting slot 232, a space for the user's fingers to operate can be provided by the slot hole 241. Therefore, it is favorable for the user to pull the first portion 223 to move relative to the supporting side 211, and the picking and placing of the object to be positioned can be more convenient. It should be mentioned that the slot hole 241 can also be disposed on the first portion 223 parallel to an extending direction of the supporting side 211, but the present disclosure is not limited thereto.

As shown in FIG. 3, the opening 242 is disposed on the second plate element 252. Specifically, in the packaging material structure 200, the opening 242 can be disposed adjacent to the side-plate side 254. Therefore, when the supporting plate 210, the base plate 220, the side plate 250 and the end plate 270 are bent toward each other, the opening 242 can be correspondingly communicated with the slot hole 241.

The positioning element 261 is integrally connected to the second plate element 252, the positioning slot 262 is disposed on the supporting plate 210, and the positioning slot 262 is recessed on the supporting side 211. In detail, the positioning element 261 can be an arc-shaped protruding structure, and the positioning element 261 is located between the first plate element 251 and the second plate element 252. Therefore, when the supporting plate 210, the base plate 220 and the side plate 250 are bent toward each other, the positioning element 261 can be correspondingly inserted in the positioning slot 262.

The end plate 270 is connected to the side-plate side 254, so that the end plate 270 can abut against the base plate 220 when the packaging material structure 200 is assembled. Therefore, the structural stability of the packaging material structure 200 can be enhanced, the strength of the packaging material structure 200 abutted against an object to be positioned (not shown) can be enhanced, and the effect of the packaging material structure 200 in positioning the object to be positioned can be enhanced.

The third foldable area 203 is disposed on the end plate 270, and the end plate 270 and the side plate 250 can be bent toward each other along the third foldable area 203. Specifically, in the packaging material structure 200, the end plate 270 can be integrally connected to the side plate 250, and the third foldable area 203 can be disposed on one side (its reference numeral is omitted) of the end plate 270 connected to the side plate 250 by the creasing method so as to facilitate the user to bend the end plate 270, and the present disclosure is not limited to the creasing method.

Further, the packaging material structure 200 can be made of the paper material, the paper material can be the cardboard or the corrugated paper, wherein the corrugated paper can be the G flute corrugated paper, the F flute corrugated paper, the E flute corrugated paper, the B flute corrugated paper, the C flute corrugated paper, the A flute corrugated paper, the BC flute corrugated paper, the BE flute corrugated paper, the AB corrugated paper, etc., and the packaging material structure 200 can also be integrally formed by bending other plate, but the present disclosure is not limited thereto.

Figure 5:
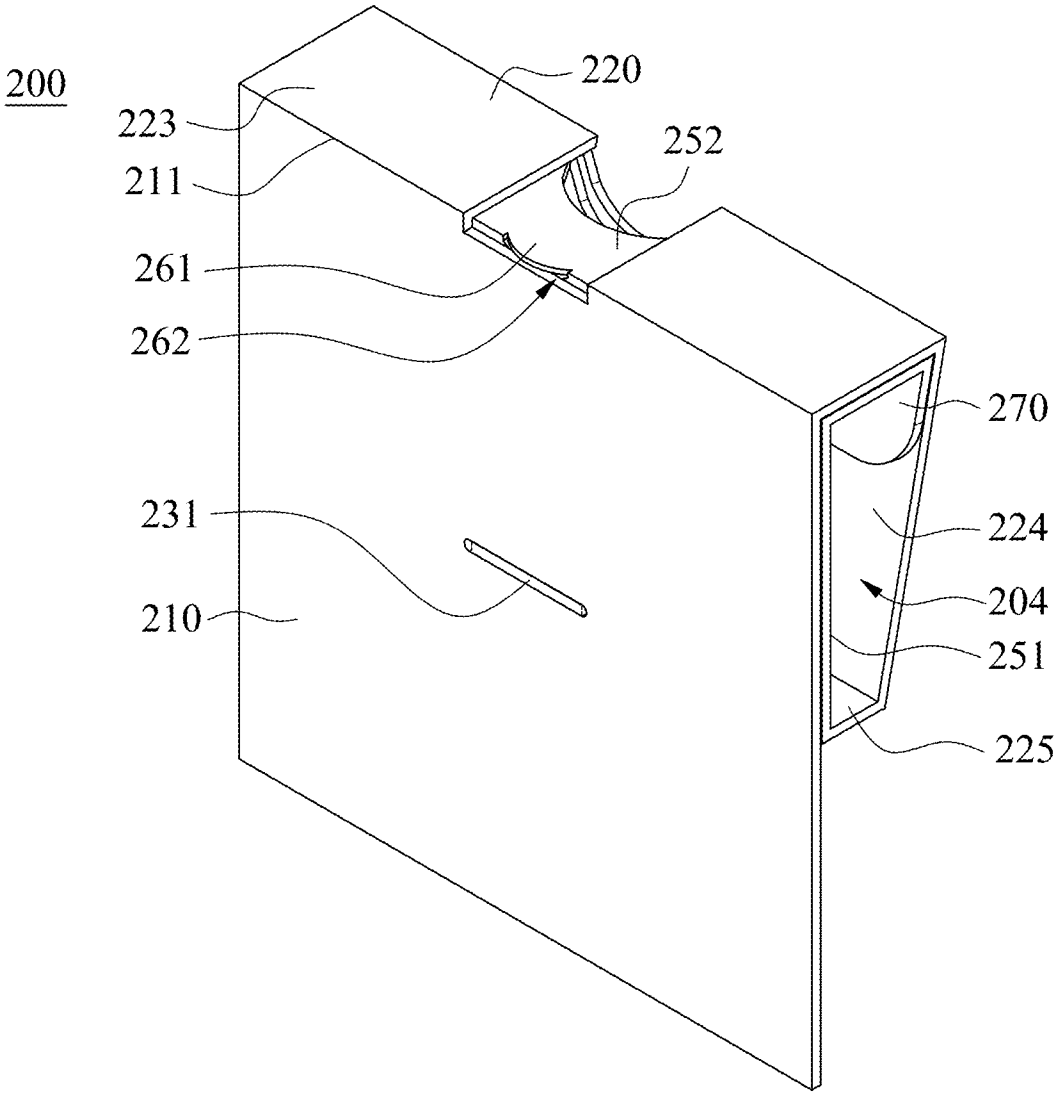
FIG. 5 is a schematic view of the packaging material structure of FIG. 4 from another direction.

Reference is made to FIG. 3 to FIG. 5, wherein FIG. 4 is a bending schematic view of the packaging material structure 200 of FIG. 3, and FIG. 5 is a schematic view of the packaging material structure 200 of FIG. 4 from another direction. As shown in FIG. 3 to FIG. 5, the supporting plate 210 and the base plate 220 are bent toward each other along the first foldable area 201 when the packaging material structure 200 is to be assembled, and then the base plate 220, the side plate 250 and the end plate 270 are located on the same side of the supporting plate 210 as the supporting surface 212. Further, the end plate 270 and the side plate 250 are bent toward each other along the third foldable area 203, and then the second plate element 252 and the first plate element 251 are bent toward each other along the side plate folding line 253. Furthermore, the side plate 250 is bent toward the supporting surface 212 along the second foldable area 202, and then the third portion 225, the second portion 224 and the first portion 223 of the base plate 220 are bent toward the supporting surface 212 along the two base plate folding lines 222. Because both of the base plate 220 and the side plate 250 are bent toward the supporting surface 212, the base plate 220 and the side plate 250 can form a frame body 204. At the same time, the side plate 250 can abut against the supporting surface 212, and the end plate 270 can abut against the base plate 220. Further, the first plate element 251 can abut against the supporting surface 212, so that the inserting element 231 can be correspondingly inserted in the inserting slot 232, and the second plate element 252 can be located in the frame body 204 and stacked on the first portion 223 of the base plate 220. Hence, the positioning element 261 can be correspondingly inserted in the positioning slot 262, the opening 242 can be correspondingly communicated with the slot hole 241, and the end plate 270 can be located in the frame body 204 and abut against the second portion 224. Therefore, the structural stability of the packaging material structure 200 and the positioning effect of the object to be positioned can be enhanced.

By the arrangements that the supporting plate 210 and the base plate 220 are bent toward each other along the first foldable area 201, the base plate 220 is for bending toward the supporting surface 212 along the two base plate folding lines 222, and the side plate 250 is bent toward the supporting surface 212 along the second foldable area 202, the base plate 220 and the side plate 250 can form the frame body 204. At the same time, the inserting element 231 can be correspondingly inserted in the inserting slot 232, and the positioning element 261 can be correspondingly inserted in the positioning slot 262. Therefore, the packaging material structure 200 of the present disclosure can be easily assembled, the packaging material structure 200 can be effectively inserted in and fill with the space between the object to be positioned and a box body (not shown), and the object to be positioned from being damaged due to shaking during transportation can be avoided. Further, by the arrangements that the packaging material structure 200 includes the end plate 270, and the end plate 270 and the side plate 250 are bent toward each other along the third foldable area 203, the structural stability of the packaging material structure 200 of the present disclosure and the positioning effect of the object to be positioned can be further enhanced. Furthermore, as mentioned before, in some embodiments, the packaging material structure 200 does not include the inserting element 231 and the inserting slot 232, and the integral structure of the packaging material structure 200 is stabilized by the positioning element 261 and the positioning slot 262, which does not depart from the scope or spirit of the present disclosure.

Figure 6:
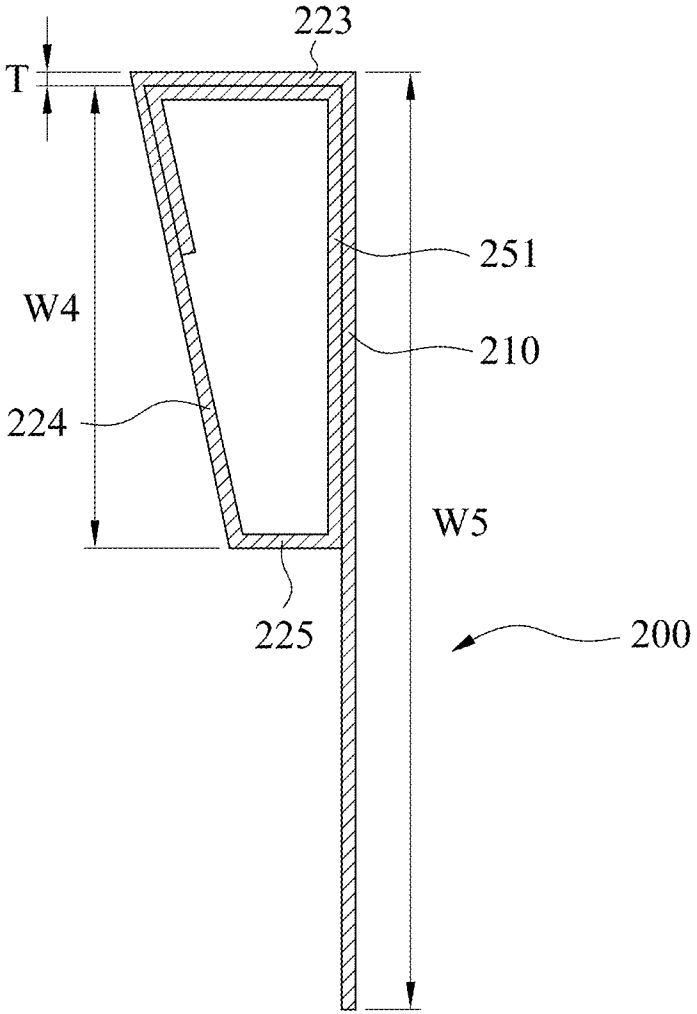
FIG. 6 is a side view of the packaging material structure of FIG. 4.

Reference is made to FIG. 3 and FIG. 6, wherein FIG. 6 is a side view of the packaging material structure 200 of FIG. 4. As shown in FIG. 3 and FIG. 6, in the packaging material structure 200, when a maximum width of the first portion 223 is W1, a maximum width of the second portion 224 is W2, a maximum width of the third portion 225 is W3, a maximum width of the first plate element 251 is W4, a maximum width of the supporting plate 210 is W5, and a thickness of the first portion 223 is T, the following conditions can be satisfied: $W1 \geq W3$; $W2 \geq W4$; and $T+W4<W5-T-W4$.

Further, when $W1 \geq W3$ is satisfied, the space between the object to be positioned and the box body can be effectively filled with the packaging material structure 200 that can accord to the shape of the object to be positioned, so that the object to be positioned from being damaged due to shaking during transportation can be avoided. Further, when $W2 \geq W4$ is satisfied, the distortion allowance of the base plate 220 can be enhanced, so that the picking and placing of the object to be positioned can be more convenient. Furthermore, when $T+W4<W5-T-W4$ is satisfied, the positioning element 261 can be firmly inserted in the positioning slot 262, the distortion allowance of the base plate 220 can be further enhanced, and the convenience of use of the packaging material structure 200 can be enhanced.

Reference is made to FIG. 4 and FIG. 7, wherein FIG. 7 is an adjusting schematic view of the packaging material structure 200 of FIG. 4. As shown in FIG. 4 and FIG. 7, the slot hole 241 and the opening 242 can be sequentially passed through by the user's finger (not shown), so that the second plate element 252 is abutted against the user's finger, and then the first portion 223 can be pulled up. At the same time, the first portion 223 is displaced relative to the supporting side 211, and the second portion 224 and the third portion 225 can be close to the first plate element 251 due to the displacement of the first portion 223. Therefore, there is a space between the object to be positioned and the packaging material structure 200, and it is favorable for picking the object to be positioned from the box body. Further, by the packaging material structure 200 is deformed by the above method, the convenience of placing the object to be positioned can be enhanced, so that the packaging material structure 200 of the present disclosure has the application potential in the relevant market.

Figure 8:
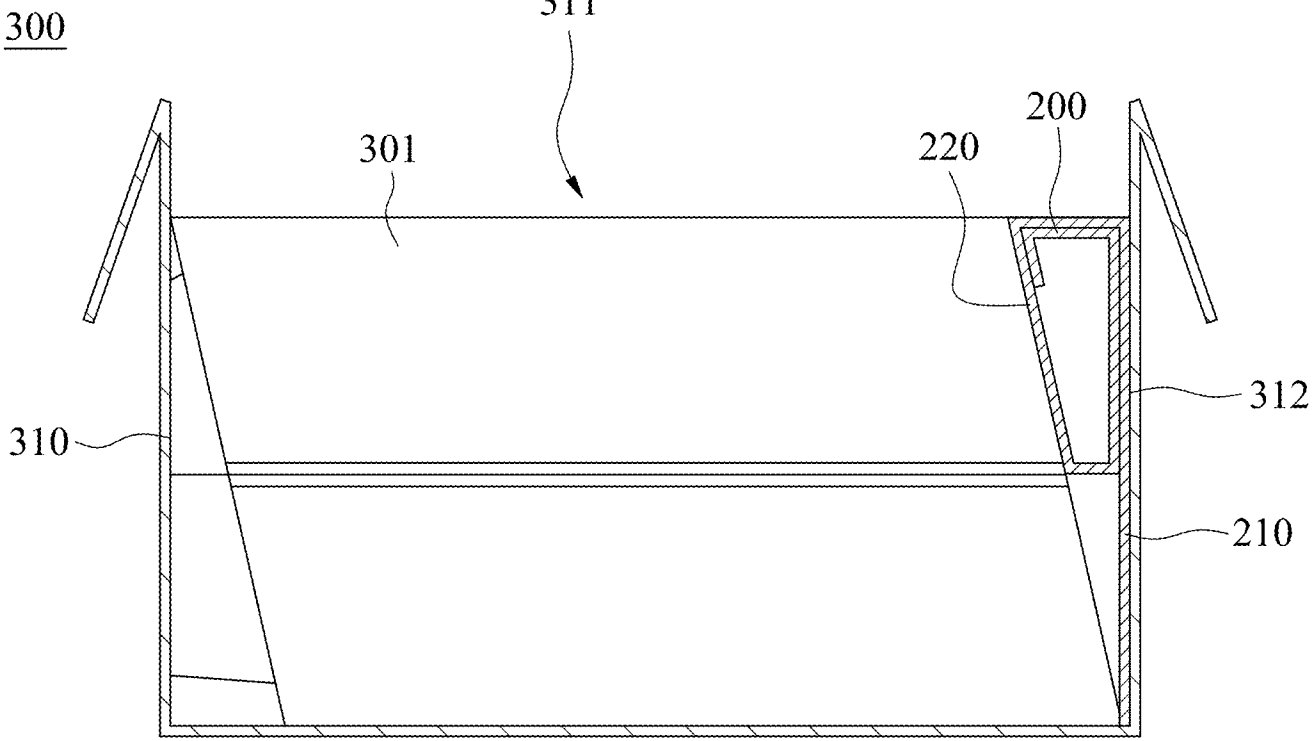
FIG. 8 is a cross-sectional view of a packaging structure according to the third embodiment of the present disclosure.

Reference is made to FIG. 8, which is a cross-sectional view of a packaging structure 300 according to the third embodiment of the present disclosure. The packaging structure 300 includes a box body 310 and a packaging material structure 200, wherein the packaging material structure 200 in FIG. 8 is the packaging material structure 200 that is folded in FIG. 4, so that the details of the same elements are not described herein again.

The box body 310 has an accommodating space 311 and an inner surface 312.

The packaging material structure 200 is detachably disposed in the accommodating space 311, and the packaging material structure 200 abuts against the inner surface 312 of the box body 310. In specific, the supporting plate 210 of the packaging material structure 200 is inserted between an object to be positioned 301 and the inner surface 312 of the box body 310. Further, the supporting plate 210 abuts against the inner surface 312 of the box body 310, and the base plate 220 abuts against the object to be positioned 301. Hence, a space between the object to be positioned 301 and the box body 310 can be filled with the packaging material structure 200, and the object to be positioned 301 can be firmly positioned in the box body 310, so that the object to be positioned 301 from being damaged due to shaking during transportation can be avoided. Furthermore, the operation and deformation method of the packaging material structure 200 is described in FIG. 7 and will not be further described herein.

By the arrangement that the packaging structure 300 includes the packaging material structure 200, the space between the object to be positioned 301 and the box body 310 can be filled with the packaging material structure 200, so that the positioning effect of the packaging structure 300 can be enhanced. Further, the object to be positioned 301 can be easily picked and placed by the simple operations of the packaging material structure 200 of the present disclosure, so that the convenience of use and the positioning effect of the packaging structure 300 of the present disclosure can be greatly enhanced, and the packaging structure 300 of the present disclosure has the application potential in the relevant market.

Figure 9:
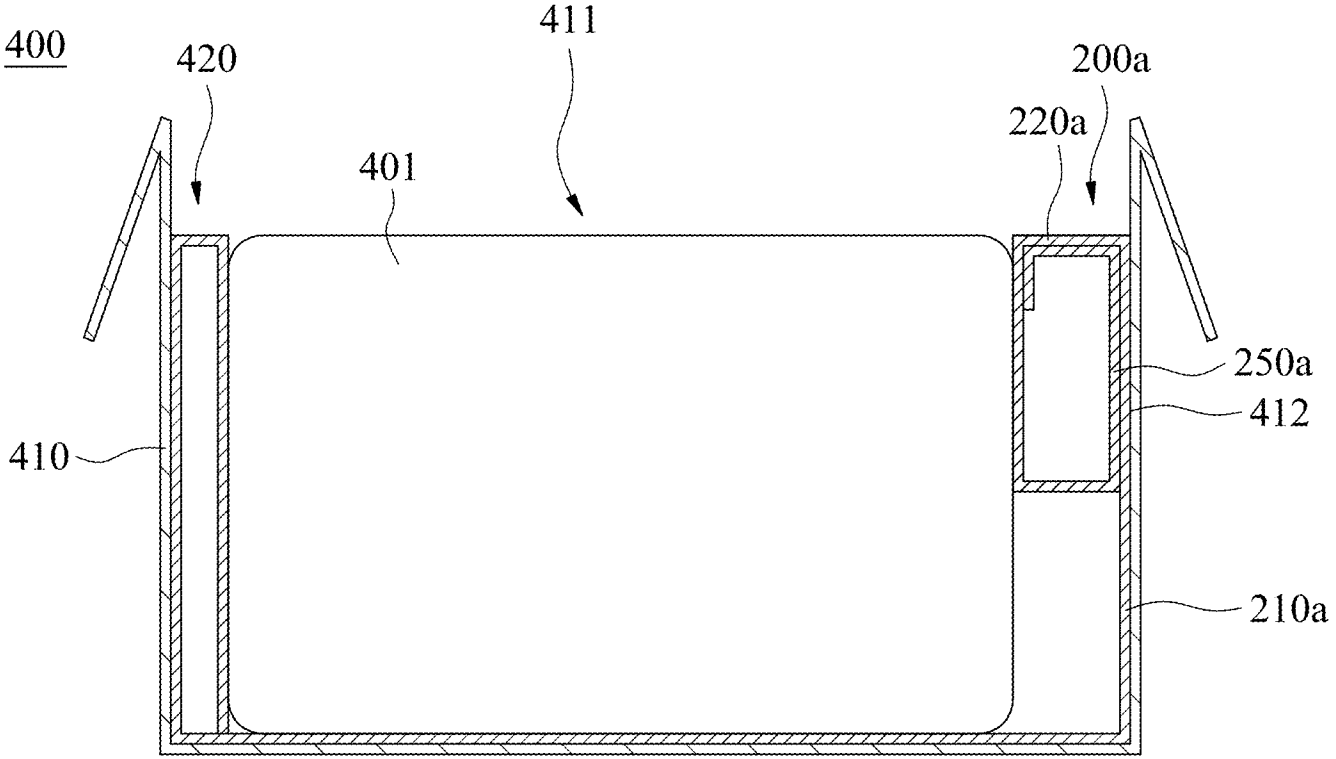
FIG. 9 is a cross-sectional view of a packaging structure according to the fourth embodiment of the present disclosure.

Reference is made to FIG. 9, which is a cross-sectional view of a packaging structure 400 according to the fourth embodiment of the present disclosure. The packaging structure 400 includes a box body 410, a lining structure 420 and a packaging material structure 200*a*.

The box body 410 has an accommodating space 411 and an inner surface 412.

The lining structure 420 is detachably disposed in the accommodating space 411 and abuts against the inner surface 412 of the box body 410, wherein the lining structure 420 can be bent from a plate to form a cushioning structure having an accommodating space (its reference numeral is omitted), so that the shock absorbing effect, the cushioning effect and the positioning effect of the box body 410 can be enhanced when the box body 410 is used with the packaging material structure 200*a*.

The packaging material structure 200*a* is detachably disposed in the accommodating space 411, and the packaging material structure 200*a* abuts against the inner surface 412 of the box body 410. In specific, the difference between the packaging material structure 200*a* and the packaging material structure 200 of FIG. 4 is the size of a base plate 220*a* and the size of a side plate 250*a*. As shown in FIG. 6 and FIG. 9, a cross section of the packaging material structure 200 is roughly trapezoidal in shape, and a cross section of the packaging material structure 200*a* is roughly rectangular in shape.

As shown in FIG. 9, in the packaging structure 400, the packaging material structure 200*a* is integrally connected to the lining structure 420. Specifically, the lining structure 420 is integrally connected to one side (its reference numeral is omitted) of the supporting plate 210*a* away from a supporting side (its reference numeral is omitted), and the base plate 220*a* abuts against an object to be positioned 401. Hence, a space between the object to be positioned 401 and the box body 410 can be filled with the packaging material structure 200*a*, and the object to be positioned 401 can be firmly positioned in the box body 410, so that the object to be positioned 401 from being damaged due to shaking during transportation can be avoided. Further, the object to be positioned 401 can be easily picked and placed by the simple operations of the packaging material structure 200*a*, so that the convenience of use of the packaging structure 400 of the present disclosure can be greatly enhanced.

Figure 10:
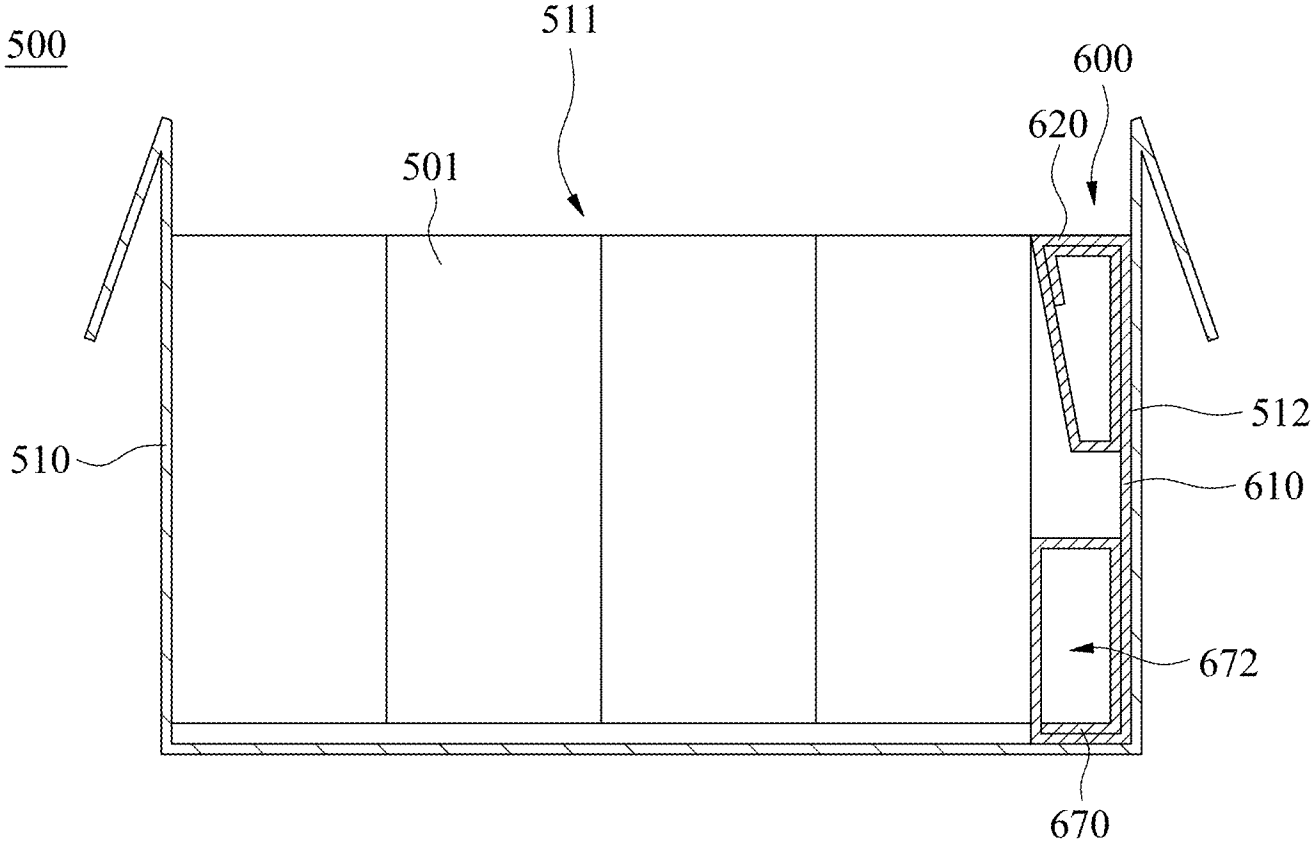
FIG. 10 is a cross-sectional view of a packaging structure according to the fifth embodiment of the present disclosure.
Figure 11:
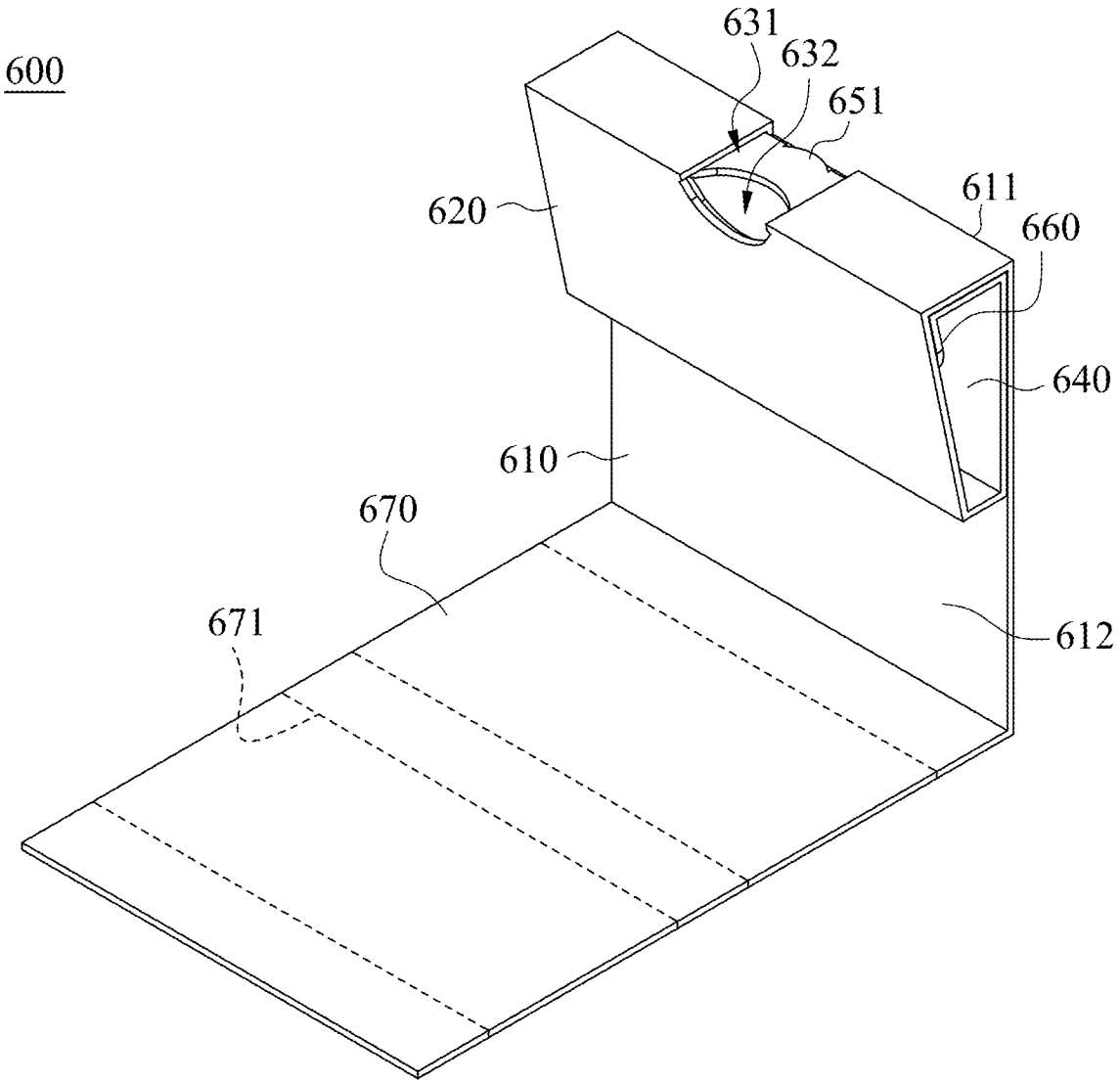
FIG. 11 is a partial bending schematic view of a packaging material structure of the packaging structure of FIG. 10.

Reference is made to FIG. 10 and FIG. 11. FIG. 10 is a cross-sectional view of a packaging structure 500 according to the fifth embodiment of the present disclosure. FIG. 11 is a partial bending schematic view of a packaging material structure 600 of the packaging structure 500 of FIG. 10. The packaging structure 500 includes a box body 510 and a packaging material structure 600.

The box body 510 has an accommodating space 511 and an inner surface 512.

The packaging material structure 600 is detachably disposed in the accommodating space 511, and the packaging material structure 600 abuts against the inner surface 512 of the box body 510. The packaging material structure 600 includes a supporting plate 610, a base plate 620, a side plate 640, a slot hole 631, an opening 632, a positioning element 651, an end plate 660 and an extending plate 670, wherein the supporting plate 610, the base plate 620, the side plate 640, the slot hole 631, the opening 632, the positioning element 651 and the end plate 660 are similar in the structures of the supporting plate 210, the base plate 220, the side plate 250, the slot hole 241, the opening 242, the positioning element 261 and the end plate 270 of FIG. 3, and the bending method of the packaging material structure 600 is similar to the bending method of the packaging material structure 200, so that the details of the same method is not described herein again.

The extending plate 670 is connected to one side of the supporting plate 610 away from the supporting side 611, and the extending plate 670 includes a plurality of extending plate folding lines 671. The plurality of extending plate folding lines 671 are separately disposed on the extending plate 670, wherein the extending plate 670 can be bent toward the supporting surface 612 along the plurality of extending plate folding lines 671, so that the extending plate 670 and the supporting plate 610 can form an extending frame body 672. In detail, in the packaging material structure 600, the extending plate 670 can be integrally connected to one side of the supporting plate 610 away from the supporting side 611. When the extending plate 670 is bent toward the supporting surface 612 along the plurality of extending plate folding lines 671, the extending plate 670 partially abuts against the supporting surface 612. At the same time, the extending plate 670 that is bent can be positioned on the supporting plate 610 by using buckles or a glue, so that the weight distribution of the supporting plate 610 relative to the supporting surface 612 can be more even, and the structural strength of the packaging material structure 600 can be enhanced.

As shown in FIG. 10, the packaging material structure 600 is inserted between the object to be positioned 501 and the inner surface 512 of the box body 510, wherein the packaging material structure 600 abuts against the inner surface 512 of the box body 510 by the supporting plate 610, and the packaging material structure 600 abuts against the object to be positioned 501 by the base plate 620 and the extending plate 670. Hence, a space between the object to be positioned 501 and the box body 510 can be filled with the packaging material structure 600, and the object to be positioned 501 can be firmly positioned in the box body 510, so that the object to be positioned 501 from being damaged due to shaking during transportation can be avoided. Further, the object to be positioned 501 can be easily picked and placed by the simple operations of the packaging material structure 600, so that the convenience of use of the packaging structure 500 of the present disclosure can be greatly enhanced. Furthermore, by the arrangement that the packaging material structure 600 includes the extending plate 670, the structural strength of the packaging material structure 600 can be effectively enhanced, and the positioning effect of the packaging structure 500 can be effectively enhanced.

According to the above, by the arrangements that the supporting plate and the base plate are bent toward each other along the first foldable area, and the base plate is for bending toward the supporting surface along the two base plate folding lines, the packaging material structure can be presented as a frame body that is roll-shaped in appearance. Therefore, the assembling convenience of the packaging material structure can be greatly achieved, the packaging material structure can be effectively inserted in and fill with the space between the object to be positioned and the box body, and the object to be positioned from being damaged due to shaking during transportation can be avoided. Further, when the object to be positioned is picked from the box body, the base plate can be pulled upward to displace the base plate relative to the supporting plate, so that there is a space between the object to be positioned and the packaging material structure. Therefore, the object to be positioned can be easily picked from the box body, and the picking and placing of the object to be positioned can be more convenient. Further, by the arrangements that the size relationships of the supporting plate, the base plate and the side plate are satisfied, the space between the object to be positioned and the box body can be effectively filled with the packaging material structure, so that the object to be positioned being damaged due to shaking during transportation can be avoided, and the picking and placing of the object to be positioned can be more convenient. Furthermore, the stability and the positioning effect of the packaging material structure can be enhanced by the arrangement of the packaging material structure including the end plate. Moreover, by the arrangement that the packaging material structure includes the extending plate, it is favorable for enhancing the structural strength of the packaging material structure, and the positioning effect of the packaging structure can be further enhanced. Therefore, the convenience of use and the positioning effect of the packaging material structure and the packaging structure can be greatly achieved, which have the application potential in the relevant market.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A packaging material structure, comprising:

a supporting plate having a supporting side and a supporting surface;

a base plate connected to the supporting side and having a base plate side, and the base plate comprising:

two base plate folding lines separately disposed on the base plate;

a first foldable area disposed on the supporting plate, and the supporting plate and the base plate bent toward each other along the first foldable area;

an inserting element integrally connected to the base plate side; and an inserting slot disposed on the supporting plate;

wherein the base plate is for bending toward the supporting surface along the two base plate folding lines, so that the inserting element is correspondingly inserted in the inserting slot;

wherein the base plate side is located on one side of the base plate away from the supporting plate;

wherein the inserting element protrudes out of the base plate.

2. The packaging material structure of claim 1, wherein the base plate is divided into a first portion, a second portion and a third portion by the two base plate folding lines, the first portion is connected to the supporting plate, the second portion is disposed between the first portion and the third portion, and the inserting element is connected to the third portion.

3. The packaging material structure of claim 2, wherein a maximum width of the first portion is W1, a maximum width of the third portion is W3, and the following condition is satisfied:

$$W1 \geq W3.$$

4. The packaging material structure of claim 2, further comprising:

a side plate integrally connected to the base plate side; and a second foldable area disposed on the side plate, and the side plate bent toward the supporting surface along the second foldable area;

wherein when the base plate is bent toward the supporting surface along the two base plate folding lines, and the side plate is bent toward the supporting surface along the second foldable area, the base plate and the side plate form a frame body, and the side plate abuts against the supporting surface.

5. The packaging material structure of claim 4, wherein the side plate comprises:

a first plate element connected to the base plate;

a second plate element connected to the first plate element; and a side plate folding line disposed between the first plate element and the second plate element, and the first plate element and the second plate element bent toward each other along the side plate folding line.

6. The packaging material structure of claim 5, further comprising:

a slot hole disposed on the first portion; and an opening disposed on the second plate element;

wherein when the base plate and the side plate form the frame body, the first plate element and the second plate element are bent along the side plate folding line, and then the second plate element is located in the frame body and stacked on the first portion, so that the opening is communicated with the slot hole.

7. The packaging material structure of claim 5, wherein a thickness of the first portion is T, a maximum width of the second portion is W2, a maximum width of the first plate element is W4, a maximum width of the supporting plate is W5, and the following conditions are satisfied:

$$W2 \geq W4; \text{ and}$$

$$T + W4 < W5 - T - W4.$$

8. The packaging material structure of claim 4, further comprising:

an end plate, wherein the side plate has a side-plate side, the side-plate side is parallel to the base plate side, and the end plate is connected to the side-plate side; and a third foldable area disposed on the end plate, and the end plate and the side plate bent toward each other along the third foldable area.

9. A packaging material structure, comprising:

a supporting plate having a supporting side and a supporting surface;

a base plate connected to the supporting side and having a base plate side, and the base plate comprising:

two base plate folding lines separately disposed on the base plate;

a first foldable area disposed on the supporting plate, and the supporting plate and the base plate bent toward each other along the first foldable area;

a side plate connected to the base plate side, and the side plate comprising:

a first plate element connected to the base plate;

a second plate element connected to the first plate element; and a side plate folding line disposed between the first plate element and the second plate element, and the first plate element and the second plate element bent toward each other along the side plate folding line;

a second foldable area disposed on the side plate, and the side plate bent toward the supporting surface along the second foldable area;

a positioning element integrally connected to the second plate element; and a positioning slot recessed on the supporting side;

wherein when the base plate is bent toward the supporting surface along the two base plate folding lines, and the side plate is bent toward the supporting surface along the second foldable area, the base plate and the side plate form a frame body;

wherein when the base plate and the side plate form the frame body, the first plate element and the second plate element are bent along the side plate folding line, and then the second plate element is located in the frame body and stacked on the base plate, so that the positioning element is correspondingly inserted in the positioning slot.

10. The packaging material structure of claim 9, wherein the base plate is divided into a first portion, a second portion and a third portion by the two base plate folding lines, the first portion is connected to the supporting plate, and the second portion is disposed between the first portion and the third portion.

11. The packaging material structure of claim 10, wherein a maximum width of the first portion is W1, a maximum width of the second portion is W2, a maximum width of the third portion is W3, a maximum width of the first plate element is W4, and the following conditions are satisfied:

$$W1 \geq W3; \text{ and}$$

$$W2 \geq W4.$$

12. The packaging material structure of claim 10, further comprising:

a slot hole disposed on the first portion; and an opening disposed on the second plate element;

wherein when the base plate and the side plate form the frame body, the first plate element and the second plate element are bent along the side plate folding line, and then the second plate element is located in the frame body and stacked on the first portion, so that the opening is communicated with the slot hole.

13. The packaging material structure of claim 10, wherein a thickness of the first portion is T, a maximum width of the first plate element is W4, a maximum width of the supporting plate is W5, and the following condition is satisfied:

$$T + W4 < W5 - T - W4.$$

14. The packaging material structure of claim 9, further comprising:

an inserting element integrally connected to the base plate side; and an inserting slot disposed on the supporting plate;

wherein when the base plate and the side plate form the frame body, the first plate element abuts against the supporting surface, so that the inserting element is correspondingly inserted in the inserting slot.

15. The packaging material structure of claim 9, further comprising:

an end plate, wherein the side plate has a side-plate side, the side-plate side is parallel to the base plate side, and the end plate is connected to the side-plate side; and a third foldable area disposed on the end plate, and the end plate and the side plate bent toward each other along the third foldable area.

16. A packaging structure, comprising:

a box body having an accommodating space; and a packaging material structure detachably disposed in the accommodating space, wherein the packaging material structure abuts against an inner surface of the box body, and the packaging material structure comprises:

a supporting plate having a supporting side and a supporting surface;

a base plate connected to the supporting side and having a base plate side, and the base plate comprising:

two base plate folding lines separately disposed on the base plate;

a first foldable area disposed on the supporting plate, and the supporting plate and the base plate bent toward each other along the first foldable area;

a side plate connected to the base plate side, and the side plate comprising:

a first plate element connected to the base plate;

a second plate element connected to the first plate element; and a side plate folding line disposed between the first plate element and the second plate element, and the first plate element and the second plate element bent toward each other along the side plate folding line;

a second foldable area disposed on the side plate, and the side plate bent toward the supporting surface along the second foldable area;

a positioning element integrally connected to the second plate element; and a positioning slot recessed on the supporting side;

wherein when the base plate is bent toward the supporting surface along the two base plate folding lines, and the side plate is bent toward the supporting surface along the second foldable area, the base plate and the side plate form a frame body;

wherein when the base plate and the side plate form the frame body, the first plate element and the second plate element are bent along the side plate folding line, and then the second plate element is located in the frame body and stacked on the base plate, so that the positioning element is correspondingly inserted in the positioning slot.

17. The packaging structure of claim 16, further comprising:

a lining structure detachably disposed in the accommodating space and abutting against the inner surface of the box body.

18. The packaging structure of claim 16, wherein the base plate is divided into a first portion, a second portion and a third portion by the two base plate folding lines, the first portion is connected to the supporting plate, and the second portion is disposed between the first portion and the third portion.

19. The packaging structure of claim 18, wherein a maximum width of the first portion is W1, a maximum width of the second portion is W2, a maximum width of the third portion is W3, a maximum width of the first plate element is W4, and the following conditions are satisfied:

$$W1 \geq W3; \text{ and}$$

$$W2 \geq W4.$$

20. The packaging structure of claim 18, wherein the packaging material structure further comprises:

a slot hole disposed on the first portion; and an opening disposed on the second plate element;

wherein when the base plate and the side plate form the frame body, the first plate element and the second plate element are bent along the side plate folding line, and then the second plate element is located in the frame body and stacked on the first portion, so that the opening is communicated with the slot hole.

21. The packaging structure of claim 18, wherein a thickness of the first portion is T, a maximum width of the first plate element is W4, a maximum width of the supporting plate is W5, and the following condition is satisfied:

$$T + W4 < W5 - T - W4.$$

22. The packaging structure of claim 16, wherein the packaging material structure further comprises:

an inserting element integrally connected to the base plate side; and an inserting slot disposed on the supporting plate;

wherein when the base plate and the side plate form the frame body, the first plate element abuts against the supporting surface, so that the inserting element is correspondingly inserted in the inserting slot.

23. The packaging structure of claim 16, wherein the packaging material structure further comprises:

an end plate, wherein the side plate has a side-plate side, the side-plate side is parallel to the base plate side, and the end plate is connected to the side-plate side; and a third foldable area disposed on the end plate, and the end plate and the side plate bent toward each other along the third foldable area.

24. The packaging structure of claim 16, wherein the packaging material structure further comprises:

an extending plate connected to one side of the supporting plate away from the supporting side, and the extending plate comprising:

a plurality of extending plate folding lines separately disposed on the extending plate, wherein the extending plate is bent toward the supporting surface along the plurality of extending plate folding lines, so that the extending plate and the supporting plate form an extending frame body.

* * * * *